US008122862B2

(12) United States Patent
Hicks et al.

(10) Patent No.: US 8,122,862 B2
(45) Date of Patent: Feb. 28, 2012

(54) ENGINE INCLUDING CYLINDER DEACTIVATION ASSEMBLY AND METHOD OF CONTROL

(75) Inventors: James B. Hicks, Shelby Township, MI (US); William C. Albertson, Clinton Township, MI (US); Mark Stabinsky, Troy, MI (US); Mike M. McDonald, Macomb, MI (US)

(73) Assignee: GM Global Technology Operations LLC

( * ) Notice: Subject to any disclaimer, the term of this patent is extended or adjusted under 35 U.S.C. 154(b) by 355 days.

(21) Appl. No.: 12/572,526

(22) Filed: Oct. 2, 2009

(65) Prior Publication Data

US 2010/0186701 A1 Jul. 29, 2010

Related U.S. Application Data

(60) Provisional application No. 61/147,320, filed on Jan. 26, 2009.

(51) Int. Cl.
*F01L 1/34* (2006.01)

(52) U.S. Cl. ..... 123/90.16; 123/90.33; 123/90.34; 123/90.35; 123/90.44

(58) Field of Classification Search ..... 123/90.12, 123/90.13, 90.16, 90.33, 90.34, 90.35, 90.44
See application file for complete search history.

(56) References Cited

U.S. PATENT DOCUMENTS

| | | | | |
|---|---|---|---|---|
| 4,452,037 | A | 6/1984 | Waddington et al. | |
| 6,213,173 | B1 | 4/2001 | Bedi et al. | |
| 6,557,518 | B1 | 5/2003 | Albertson et al. | |
| 6,584,942 | B1 | 7/2003 | Albertson et al. | |
| 6,745,735 | B2 | 6/2004 | Smith | |
| 7,225,776 | B2 * | 6/2007 | Gecim et al. | 123/90.39 |
| 7,562,530 | B2 | 7/2009 | Kolmanovsky | |
| 7,765,052 | B2 | 7/2010 | Kaiser et al. | |
| 2006/0260323 | A1 | 11/2006 | Moulebhar | |
| 2009/0150055 | A1 | 6/2009 | Kaiser et al. | |

OTHER PUBLICATIONS

Stabinsky, Mark et al., "Active Fuel Management(TM) Technology: Hardware Development on a 2007 GM 3.9L V6 OHV SI Engine," 07PFL-431, SAE International, 2007, 11 pgs.

Albertson, William et al., "Displacement on Demand for Improved Fuel Economy without Compromising Performance in GM's High Value Engines," Powertrain International, pp. 25-40.

* cited by examiner

*Primary Examiner* — Ching Chang
(74) *Attorney, Agent, or Firm* — Harness, Dickey & Pierce, P.L.C.

(57) ABSTRACT

A method of purging air from an oil passage in communication with a lifter assembly in an engine assembly may include isolating the oil passage from a pressurized oil source while the lifter assembly is engaged with a base region of a cam lobe to operate the first lifter assembly in the activated mode. The pressurized oil may be provided to the lifter assembly via the oil passage after the isolating when the lifter assembly is engaged with a lift region of the cam lobe. The lifter assembly may be maintained in the activated mode after the providing. Air may be purged from the oil passage based on the pressurized oil provided to the oil passage.

20 Claims, 13 Drawing Sheets

ENGINE INCLUDING CYLINDER DEACTIVATION ASSEMBLY AND METHOD OF CONTROL

CROSS-REFERENCE TO RELATED APPLICATIONS

This application claims the benefit of U.S. Provisional Application No. 61/147,320, filed on Jan. 26, 2009. The entire disclosure of the above application is incorporated herein by reference.

FIELD

The present disclosure relates to engine valvetrain control, and more specifically to control of engine valvetrain systems including cylinder deactivation mechanisms.

BACKGROUND

This section provides background information related to the present disclosure which is not necessarily prior art.

Engine assemblies may include hydraulically actuated components such as deactivating valve lifters. When air is present in an oil supply passage that provides pressurized oil to the hydraulically actuated device the response time of the device may be effected due to the compressibility of the air-oil mixture within the passage. When the hydraulically actuated device is operated during conditions where air is present within the oil passage, engine operation may be adversely effected.

SUMMARY

This section provides a general summary of the disclosure, and is not a comprehensive disclosure of its full scope or all of its features.

A method is provided for purging air from an oil passage in an engine assembly. The engine assembly may include an engine structure defining the oil passage, a first cam lobe rotationally supported by the engine structure and including a base region and a lift region, a first lifter assembly supported by the engine structure and in fluid communication with the oil passage, and a first valve supported by the engine structure. The first valve may be displaceable from a seated position to a lift position by the first lifter assembly. The first lifter assembly may be switched from an activated mode to a deactivated mode by pressurized oil provided to the oil passage by a pressurized oil source. The activated mode may include the first valve being in the seated position when the base region engages the first lifter assembly and being displaced from the seated position by the first lifter assembly when the lift region engages the first lifter assembly. The deactivated mode may include the first valve remaining in the seated position when the lift region of the first cam lobe engages the first lifter assembly. The method may include isolating the oil passage from the pressurized oil source while the first lifter assembly is engaged with the base region of the first cam lobe to operate the first lifter assembly in the activated mode and providing the pressurized oil to the first lifter assembly via the oil passage after the isolating when the first lifter assembly is engaged with the lift region of the cam lobe. The first lifter assembly may be maintained in the activated mode after the providing. Air may be purged from the oil passage based on the pressurized oil provided to the oil passage.

An alternate method of purging air from an oil passage in an engine assembly is also provided. The engine assembly may include an engine structure defining the oil passage, a first cam lobe rotationally supported by the engine structure and including a base region and a lift region, a first lifter assembly supported by the engine structure and in fluid communication with the oil passage, and a first valve supported by the engine structure. The first valve may be displaceable from a seated position to a lift position by the first lifter assembly. The first lifter assembly may be switched from an activated mode to a deactivated mode by pressurized oil provided to the oil passage by a pressurized oil source. The activated mode may include the first valve being in the seated position when the base region engages the first lifter assembly and being displaced from the seated position by the first lifter assembly when the lift region engages the first lifter assembly. The deactivated mode may include the first valve remaining in the seated position when the lift region of the first cam lobe engages the first lifter assembly. The method may include isolating the oil passage from the pressurized oil source while the first lifter assembly is engaged with the base region of the first cam lobe to operate the first lifter assembly in the activated mode and providing the pressurized oil to the first lifter assembly via the oil passage after the isolating when the first lifter assembly is engaged with the lift region of the cam lobe. The first lifter assembly may be maintained in the activated mode after the providing. Air may be purged from the oil passage based on the pressurized oil provided to the oil passage. The pressurized oil may be provided to the first lifter assembly via the oil passage after the purging when the first lifter assembly is engaged with the base region of the cam lobe to switch the first lifter assembly to the deactivated mode.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
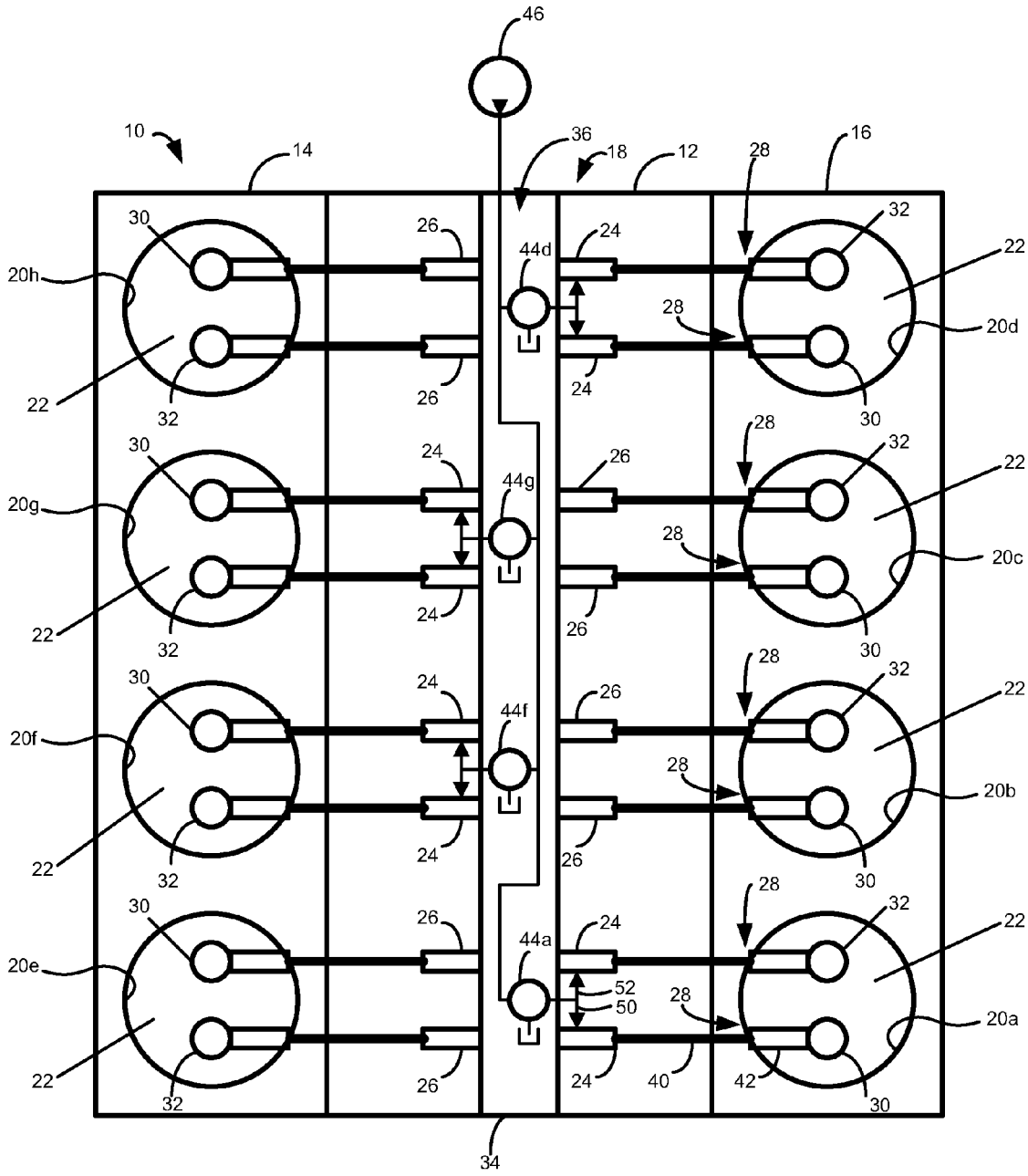
FIG. 1 is a schematic illustration of an engine assembly according to the present disclosure.

With reference to FIG. 1, an engine assembly 10 may include an engine block 12, first and second cylinder heads 14, 16, and a valvetrain assembly 18. The engine block 12 may define a plurality of cylinder bores 20*a*, 20*b*, 20*c*, 20*d*, 20*e*, 20*f*, 20*g*, 20*h* having pistons 22 disposed therein. The valvetrain assembly 18 may include deactivating lifter assemblies 24, non-deactivating lifter assemblies 26, valve actuation assemblies 28, intake and exhaust valves 30, 32, a camshaft 34, a cylinder deactivation assembly 36, and a control module 38 (seen in FIG. 2). The valve actuation assemblies 28 may each include a pushrod 40 and a rocker arm 42.

While illustrated as a V-engine with a cam-in-block configuration including eight cylinders, it is understood that the present disclosure applies equally to inline engines, as well as overhead camshaft configurations. In the present non-limiting example, the cylinders 20*a*, 20*d*, 20*f*, 20*g* may be selectively deactivated. As discussed further below, the cylinder deactivation system 36 may selectively deactivate the cylinders 20*a*, 20*d*, 20*f*, 20*g* via the deactivating lifter assemblies 24. While four (or half) of the cylinders 20*a*, 20*b*, 20*c*, 20*d*, 20*e*, 20*f*, 20*g*, 20*h* are illustrated as being capable of deactivation, the present disclosure applies equally to arrangements where fewer or more of the cylinders 20*a*, 20*b*, 20*c*, 20*d*, 20*e*, 20*f*, 20*g*, 20*h* are capable of deactivation. The present disclosure applies equally to configurations where as few as one and as many as all of the cylinders are capable of being deactivated. Further, it is understood that the present disclosure applies equally to engines having any number of cylinders. The cylinder deactivation assembly 36 may include valves 44*a*, 44*d*, 44*f*, 44*g* associated with each of the cylinders 20*a*, 20*d*, 20*f*, 20*g* capable of deactivation. The valves 44*a*, 44*d*, 44*f*, 44*g* may be in fluid communication with a pressurized oil source 46. By way of non-limited example, the pressurized oil source 46 may include an oil pump providing a pressurized oil flow.

Referring to FIGS. 2-5, the engine block 12 may define an engine structure defining an opening 48 housing the deactivating lifter assembly 24 therein and a passage 50 providing fluid communication between the valve 44*a* and the opening 48. As discussed above, the present disclosure applies equally to overhead cam configurations. In such configurations, an opening similar to opening 48 may be located in an engine structure defined by the cylinder head to house a deactivating lifter assembly similar to deactivating lifter assembly 24. A single deactivating lifter assembly 24 and valve 44*a* for the intake valve 30 associated with the cylinder 20*a* are illustrated in FIGS. 2-5 for simplicity. However, it is understood that the description applies equally to the deactivating lifter assemblies 24 and valves 44*d*, 44*f*, 44*g* associated with each of the other cylinders 20*d*, 20*f*, 20*g* capable of deactivation, as well as the deactivating lifter assembly 24 of the cylinder 20*a* associated with the exhaust valve 32. The engine block 12 may define an additional opening (not shown) housing the deactivating lifter assembly 24 associated with the exhaust valve 32 therein and may additionally include a passage 52 (seen in FIG. 1) providing fluid communication between the valve 44*a* and the lifter assemblies 24 of both intake and exhaust valves 30, 32 of a common cylinder 20*a*.

The deactivating lifter assembly 24 may include a first housing 56, a second housing 58, a hydraulic lash adjuster 60, a locking pin assembly 62, a lost motion mechanism 64, and a cam follower 66 coupled to the first housing 56. The first housing 56 may include a first opening 68 in fluid communication with the valve 44*a* via the passage 50 in the engine block 12 and a second opening 70 in fluid communication with an additional passage 72 in the engine block 12. The passage 72 may provide a pressurized oil flow to the second opening 70. The second opening 70 may be in fluid communication with the hydraulic lash adjuster 60 to maintain engagement between the pushrod 40 and the deactivating lifter assembly 24.

The locking pin assembly 62 may include first and second locking pins 74, 76 and a biasing member 78. The biasing member 78 may force the locking pins 74, 76 away from one another in radially outward directions relative to the first housing 56. The second housing 58 may define an opening 80 containing the locking pin assembly 62 therein. The first and second locking pins 74, 76 may be displaceable between engaged and disengaged positions. In the engaged position (seen in FIGS. 2 and 5), the first and second locking pins 74, 76 extend radially outward from the second housing 58 and may be engaged with the first housing 56. More specifically, the first locking pin 74 may extend into the first opening 68 of the first housing 56. In the engaged position, the locking pins 74, 76 may couple the first and second housings 56, 58 for displacement with one another. In the disengaged position (seen in FIGS. 3 and 4), the first and second locking pins 74, 76 may be displaced radially inward from the first housing 56 and disengaged therefrom, allowing relative displacement between the first and second housings 56, 58.

The lost motion mechanism 64 may include a retaining member 82 and a biasing member 84. The retaining member 82 may be axially fixed to the second housing 58 and the biasing member 84 may engage the retaining member 82 and the first housing 56, biasing the cam follower 66 into engagement with the camshaft 34. A lobe 86 of the camshaft 34 may displace the first housing 56 toward the retaining member 82 against the force of the biasing member 84 as a peak 88 of the lobe 86 engages the cam follower 66. The first housing 56 may be returned to an initial position by the biasing member 84 as a base region 90 of the cam lobe 86 engages the cam follower 66.

Figure 2:
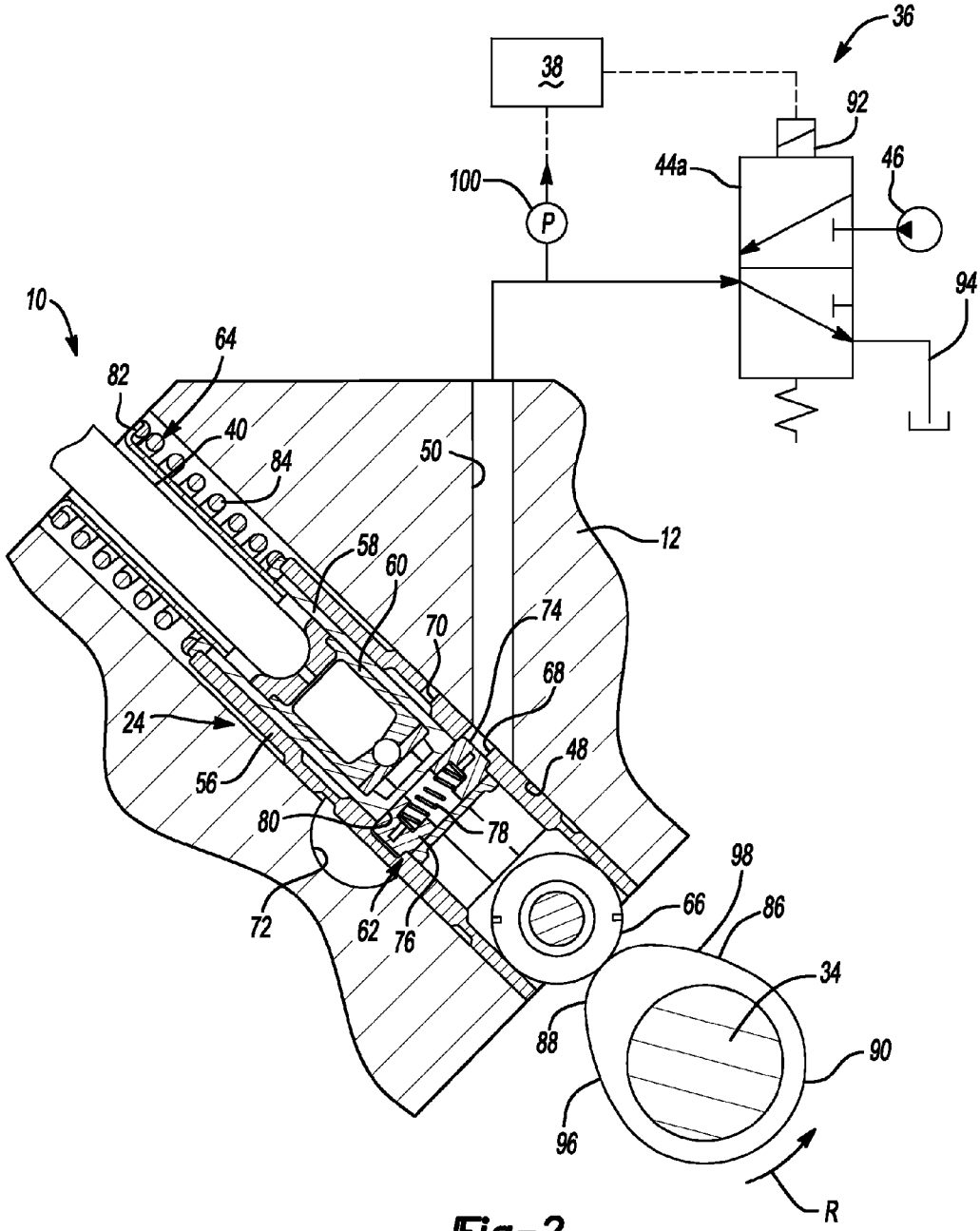
FIG. 2 is a section view of the engine assembly of FIG. 1.
Figure 3:
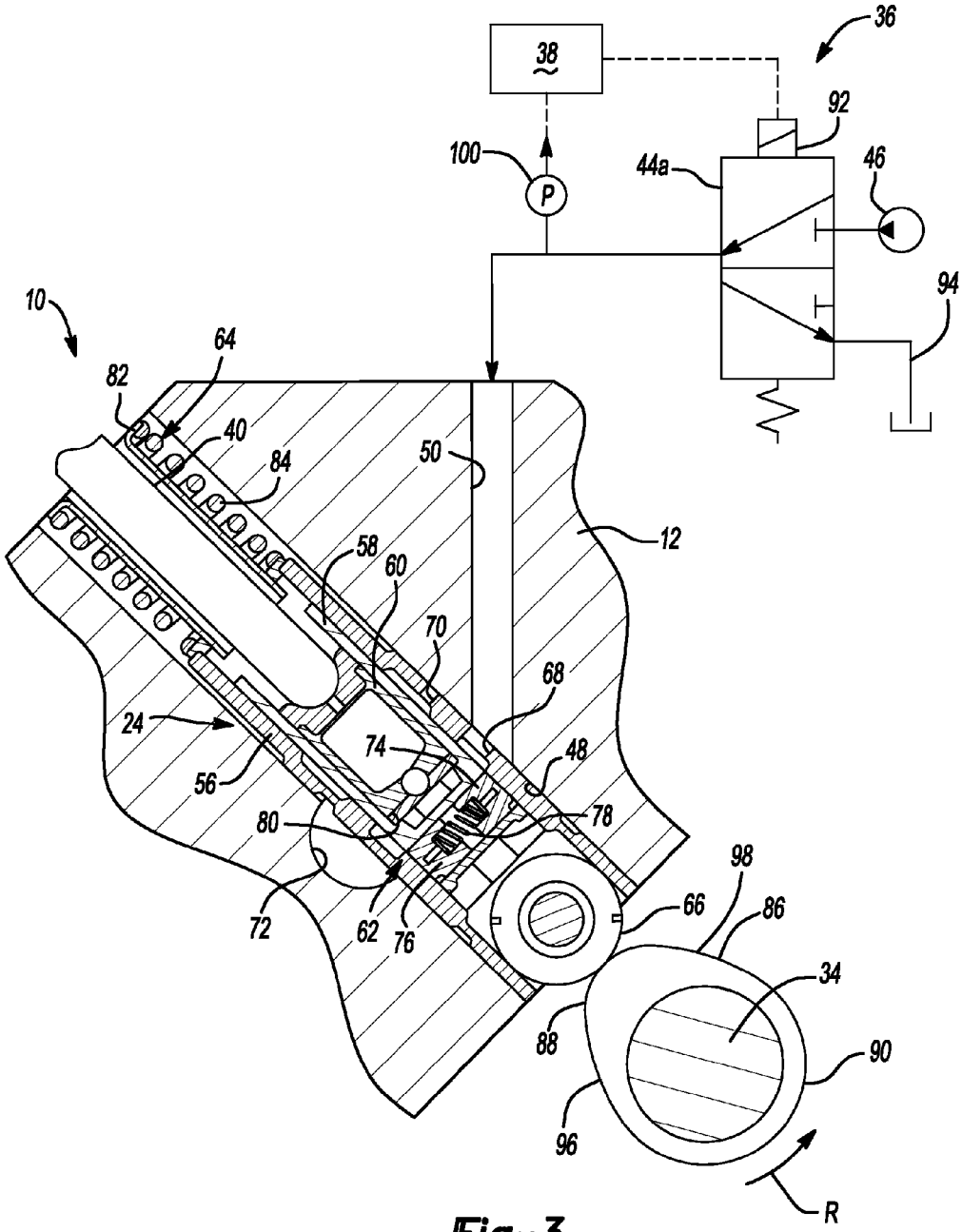
FIG. 3 is an additional section view of the engine assembly of FIG. 1.
Figure 4:
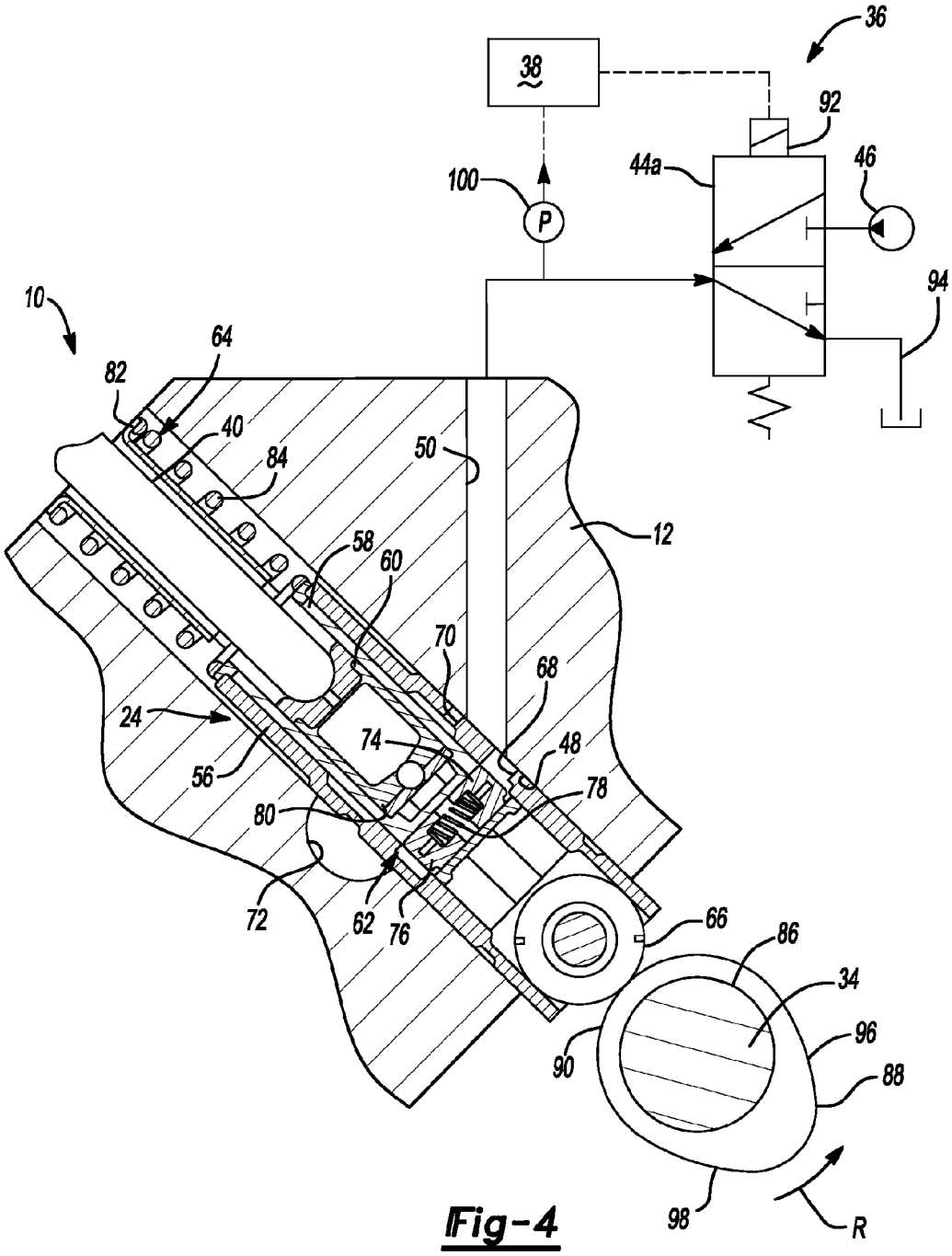
FIG. 4 is an additional section view of the engine assembly of FIG. 1.
Figure 5:
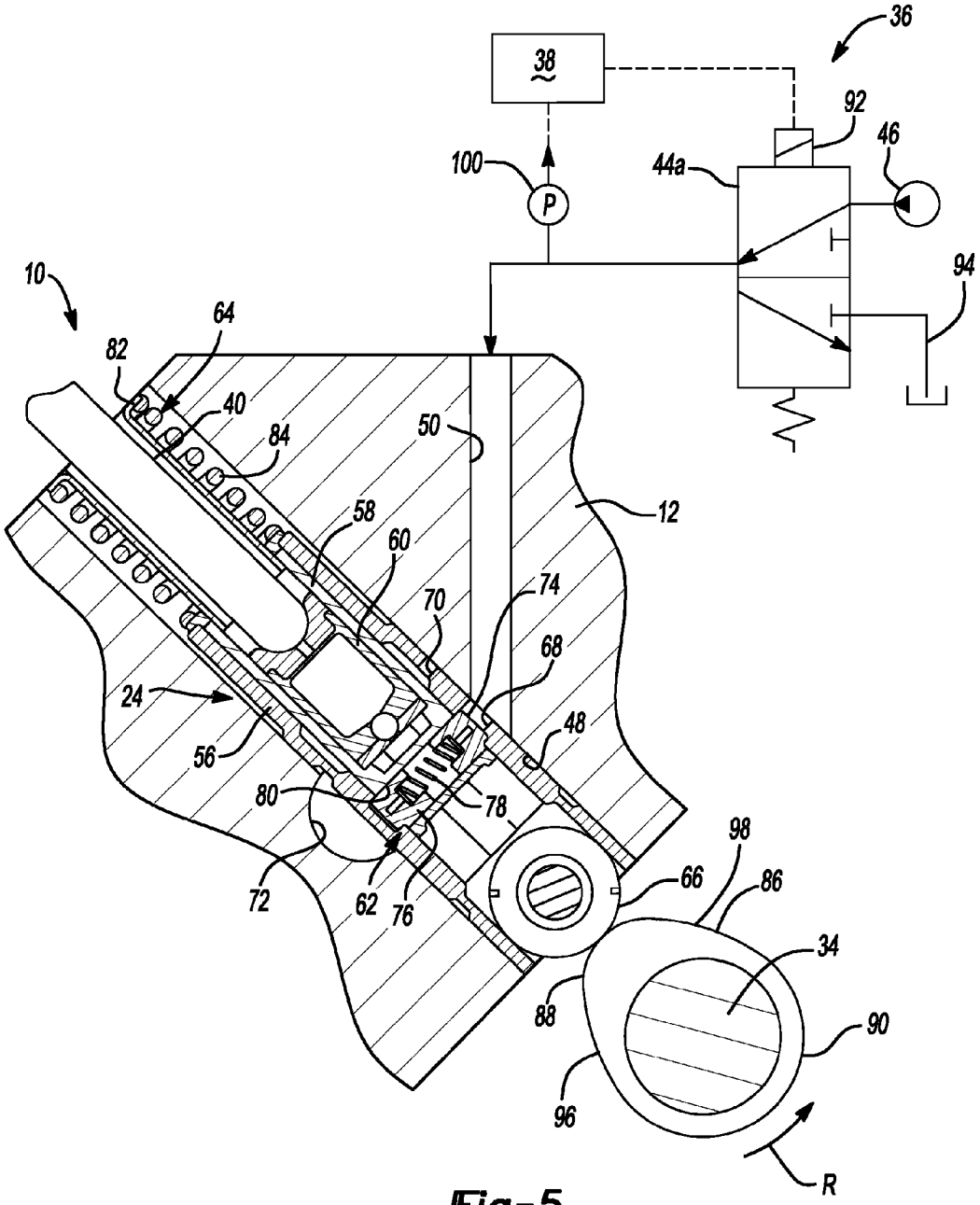
FIG. 5 is an additional section view of the engine assembly of FIG. 1.

When the first and second locking pins 74, 76 are in the engaged position, the lobe 86 of the camshaft 34 may displace the second housing 58, and therefore the pushrod 40, with the first housing 56 (as seen in FIG. 2) to open the intake valve 30 based on an engagement between the peak 88 of the lobe 86 and the cam follower 66. When the first and second locking pins 74, 76 are in the disengaged position, the first housing 56 may be displaced relative to the second housing 58 (as seen in FIG. 3) when the cam follower 66 is engaged with the peak 88 of the cam lobe 86, preventing opening of the intake valve 30.

The valve 44*a* may selectively switch the deactivating lifter assembly between activated and deactivated modes. In the activated mode, the first and second locking pins 74, 76 are in the engaged position. In the deactivated mode, the first and second locking pins 74, 76 are in the disengaged position. The valve 44*a* may selectively switch between the activated and deactivated modes by controlling a fluid supply to the first opening 68 via the passage 50. The valve 44*a* may include a solenoid 92 in communication with the control module 38 to control valve position based on engine operating conditions.

When the deactivated mode is desired, the valve 44*a* may be opened to provide fluid communication between the pressurized oil from the pressurized oil source 46 and the first opening 68. The pressurized oil may force the first and second locking pins 74, 76 to the disengaged position. When the activated mode is desired, the valve 44*a* may be closed to isolate the pressurized oil from the first opening 68 and may provide fluid communication between a vent passage 94 and the first opening 68. When the valve 44*a* is in fluid communication with the vent passage 94 (such as an engine oil sump), the force from the oil pressure may be removed from the first and second locking pins 74, 76, allowing the first and second locking pins 74, 76 to be returned to the engaged position by the biasing member 78. However, due to the positioning of the valve 44*a* relative to the passages 50, 52, a volume of oil may remain within and fill the passage 50 when the valve 44*a* is in the closed position.

During engine start-up conditions, the passage 50 in the engine block 12 may contain air. Air may be located in the passage 50 due to the volume of oil discussed above escaping through a radial clearance between the deactivating lifter assemblies 24 and the opening 48 after the engine has been shut down. The valve 44*a* may be cycled to eliminate the air in the passage 50. More specifically, the valve 44*a* may be actuated between the open and closed positions to force the air out of the passage 50 using the pressurized oil from the oil pump. The valve 44*a* may be actuated to the open position, providing pressurized oil to the passage 50 in the engine block 12 to purge air therefrom when the first and second locking pins 74, 76 are unable to be displaced to the disengaged position and/or when the displacement of the first and second locking pins 74, 76 to the disengaged position does not effect engine operation. The pressurized oil provided to the passage 50 may force trapped air from the passage 50 through the radial clearance between the first housing 56 and the opening 48 in the engine block 12 containing the deactivating lifter assembly 24.

As indicated above, the first and second locking pins 74, 76 may be unable to be displaced to the disengaged position during certain engine operating conditions even when the valve 44*a* is in the open position providing a pressurized oil supply to the first and second locking pins 74, 76. These engine operating conditions where the first and second locking pins 74, 76 are unable to be displaced to the disengaged position may include partial lift conditions. The partial lift condition may include an engagement between the lobe 86 of the camshaft 34 and the cam follower 66 corresponding to a lobe region between the base 90 and the peak 88. By way of non-limiting example, a starting point 96 on the lobe 86 past the base 90 may form a starting point for a lift region of the lobe 86 where disengagement cannot occur and an end point 98 on the lobe 86 may form an ending point for a lift region of the lobe 86 where disengagement cannot occur. The first and second locking pins 74, 76 may be unable to be displaced from the engaged position to the disengaged position as the lobe 86 engages the cam follower 66 from the starting point 96 to the ending point 98 in the rotational direction (R).

The starting and ending points 96, 98 may provide a lift condition of the deactivating lifter assembly 24 that imparts a locking axial force on the first and second locking pins 74, 76 by the first housing 56. The locking axial force may generally produce a frictional engagement between the first and second locking pins 74, 76 and the first housing 56 that is unable to be overcome by the force applied to the first and second locking pins 74, 76 by the pressurized oil source 46. As the lobe 86 engages the cam follower 66 from the starting point 96 to the ending point 98, the axial force imparted on the first and second locking pins 74, 76 may be greater than or equal to the locking axial force. Therefore, the valve 44*a* may be actuated to the open position during this time to purge air from the passage 50 without deactivating the deactivating lifter assembly 24. However, as the lobe 86 engages the cam follower 66 from the ending point 98 to the starting point 96 in the rotational direction (R), the axial force imparted on the first and second locking pins 74, 76 may be below the locking axial force. Therefore, the first and second locking pins 74, 76 may be displaced to the disengaged position during this time.

Figure 6:
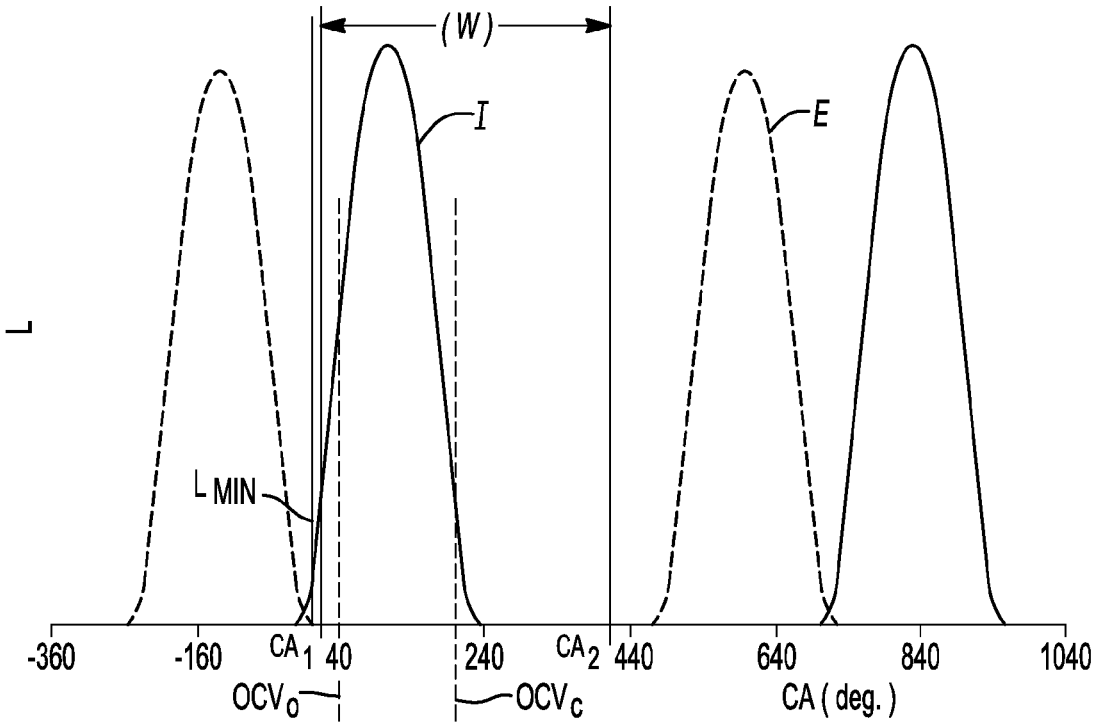
FIG. 6 is a graphical illustration of engine operating conditions.

As further indicated above, engine operating conditions may exist where the displacement of the first and second locking pins 74, 76 to the disengaged position does not effect engine operation. By way of non-limiting example, these conditions may include non-lift conditions, such as when the base 90 of the lobe 86 is engaged with the cam follower 66. When the base 90 is engaged with the cam follower 66, there is no lift, regardless of whether the first and second locking pins are in the engaged or disengaged positions. FIG. 6 graphically illustrates a non-limiting example of conditions where the passages 50, 52 associated with the cylinder 20*a* may be purged of air through actuation of the valve 44*a* to the deactivated mode without deactivating the deactivating lifter assemblies 24 associated with the intake and exhaust valves 30, 32 of cylinder 22*a*.

Figure 7:
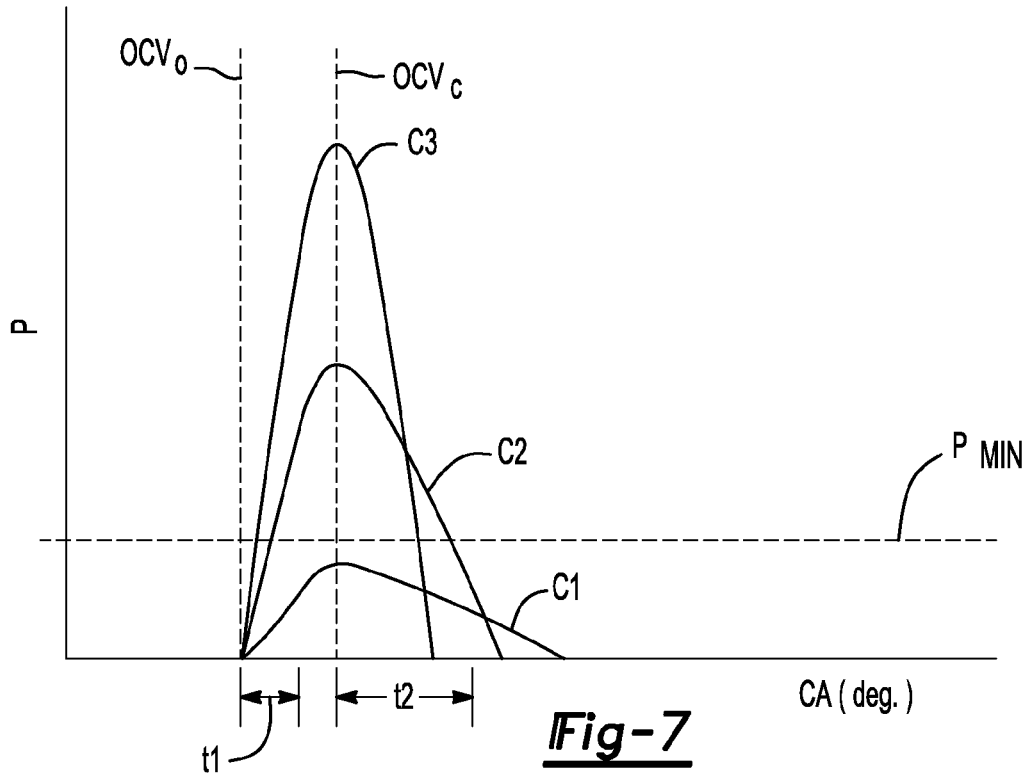
FIG. 7 is an additional graphical illustration of engine operating conditions.

FIG. 6 generally illustrates the intake and exhaust lift stroke for the intake and exhaust valves 30, 32 of cylinder 22*a*. The x-axis corresponds to crank angle and the y-axis corresponds to valve lift. The region illustrated as $CA_1$ to $CA_2$ represents the opportunities for actuating the valve 44*a* to the deactivated mode to purge air from the passages 50, 52 without deactivating the deactivating lifter assemblies 24 associated with the intake and exhaust valves 30, 32. The engine assembly 10 may additionally include a pressure sensor 100 associated with the passages 50, 52. The pressure sensor 100 may be located in passages 50 or 52 associated with the deactivating lifter assemblies 24 associated with the intake and exhaust valves 30, 32 and the valve 44*a*. The pressure sensor 100 may be in communication with the control module 38 and may provide a signal thereto indicative of the oil pressure within the passages 50, 52. A separate pressure sensor 100 may be used for each of the cylinders 20*a*, 20*d*, 20*f*, 20*g* or a single pressure sensor 100 may be used for one of the cylinders 20*a*, 20*d*, 20*f*, 20*g*. By way of non-limiting example, a single pressure sensor 100 may be used for the one of the cylinders 20*a*, 20*d*, 20*f*, 20*g* having the greatest passage volume between the valve 44*a*, 44*d*, 44*g*, 44*f* and the deactivating lifter assemblies 24 associated therewith. FIG. 7 graphically illustrates the pressure conditions sensed by the pressure sensor 100 to determine the hydraulic stiffness of the passages 50, 52 to ensure the deactivating lifter assembles 24 are able to produce desired response times, as discussed below.

Figure 8:
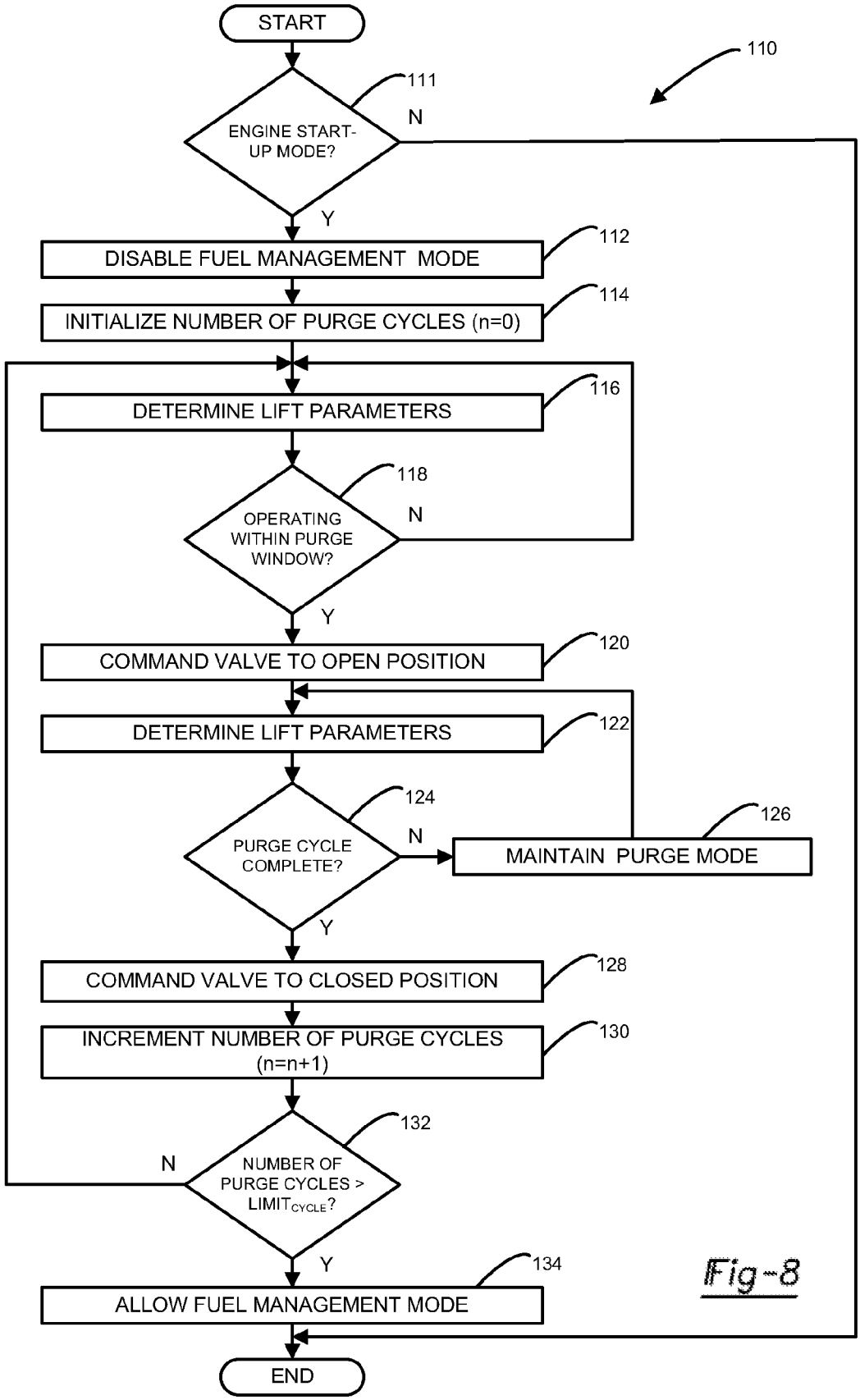
FIG. 8 is a first flow diagram illustrating control of the engine assembly of FIG. 1.

With reference to FIG. 8, control logic 110 is illustrated for purging air from the passages 50, 52 by providing oil flow from the valves 44*a*, 44*d*, 44*f*, 44*g* to the deactivating lifter assemblies 24 associated therewith. Control logic 110 may be used during a start-up condition of the engine assembly 10. For simplicity, the following description of control logic 110 is directed to the cylinder 20*a*, with the understanding that the description applies equally to the cylinders 20*d*, 20*f*, 20*g*. Control logic 110 may begin at block 111 where an engine start-up condition is evaluated. If the engine is not in a start-up mode, control logic 110 may terminate. The start-up mode may generally include conditions such as an initial engine start, as well as conditions where the engine has not operated for a predetermined time and/or conditions where the engine temperature has not reached a predetermined limit.

If the engine is in a start-up mode, control logic 110 may proceed to block 112 where the control module 38 disables a fuel management mode of the engine assembly 10, preventing the engine assembly 10 from transitioning to the deactivated mode. Control logic 110 may then proceed to block 114 where a number of purge cycles (n) stored in the control module 38 is initialized to zero (n=0). Once the number of purge cycles has been initialized, control logic 110 may proceed to block 116 where lift parameters are determined.

The lift parameters may include one or more of engine speed, engine crank angle, and a purge window (W) duration. The purge window (W) duration may generally correspond to a time period and/or crank angle range where actuation of the valve 44*a* to the open position does not effect engine operation.

Control logic 110 may then determine if the engine assembly 10 is operating within the purge window (W) at block 118. If the engine assembly 10 is not operating within the purge window (W), control logic 110 may return to block 116. If the engine assembly 10 is operating within the purge window (W), control logic 110 may proceed to block 120 where the valve 44*a* is commanded to the open position, providing pressurized oil flow to the passages 50, 52 and forcing air therefrom as discussed above. Control logic 110 may then proceed to block 122 where lift parameters are again determined.

Once the lift parameters are determined, control logic 110 may determine if the purge cycle is complete at block 124. By way of non-limiting example, the determination may include evaluation of an elapsed operating time and engine speed and/or evaluation of a current crank angle relative to a crank angle range within the purge window (W). If the purge cycle is not complete, control logic 110 may proceed to block 126 where the valve 44*a* is maintained in the open position and then back to block 122 where lift parameters are again determined. If the purge cycle is complete, control logic 110 may proceed to block 128 where the valve 44*a* is commanded to the closed position, venting the passages 50, 52. Control logic 110 may then increment the number of purge cycles (n=n+1) at block 130. Control logic 110 may then evaluate the number of purge cycles (n) relative to a predetermined limit ($LIMIT_{CYCLE}$).

If the number of purge cycles (n) is less than the limit ($LIMIT_{CYCLE}$), control logic 110 may return to block 116, where lift parameters are determined for a subsequent purge cycle. If the number of purge cycles (n) is greater than or equal to the limit ($LIMIT_{CYCLE}$), control logic 110 may proceed to block 134, where the fuel management mode is allowed. Control logic 110 may then terminate.

Figure 9:
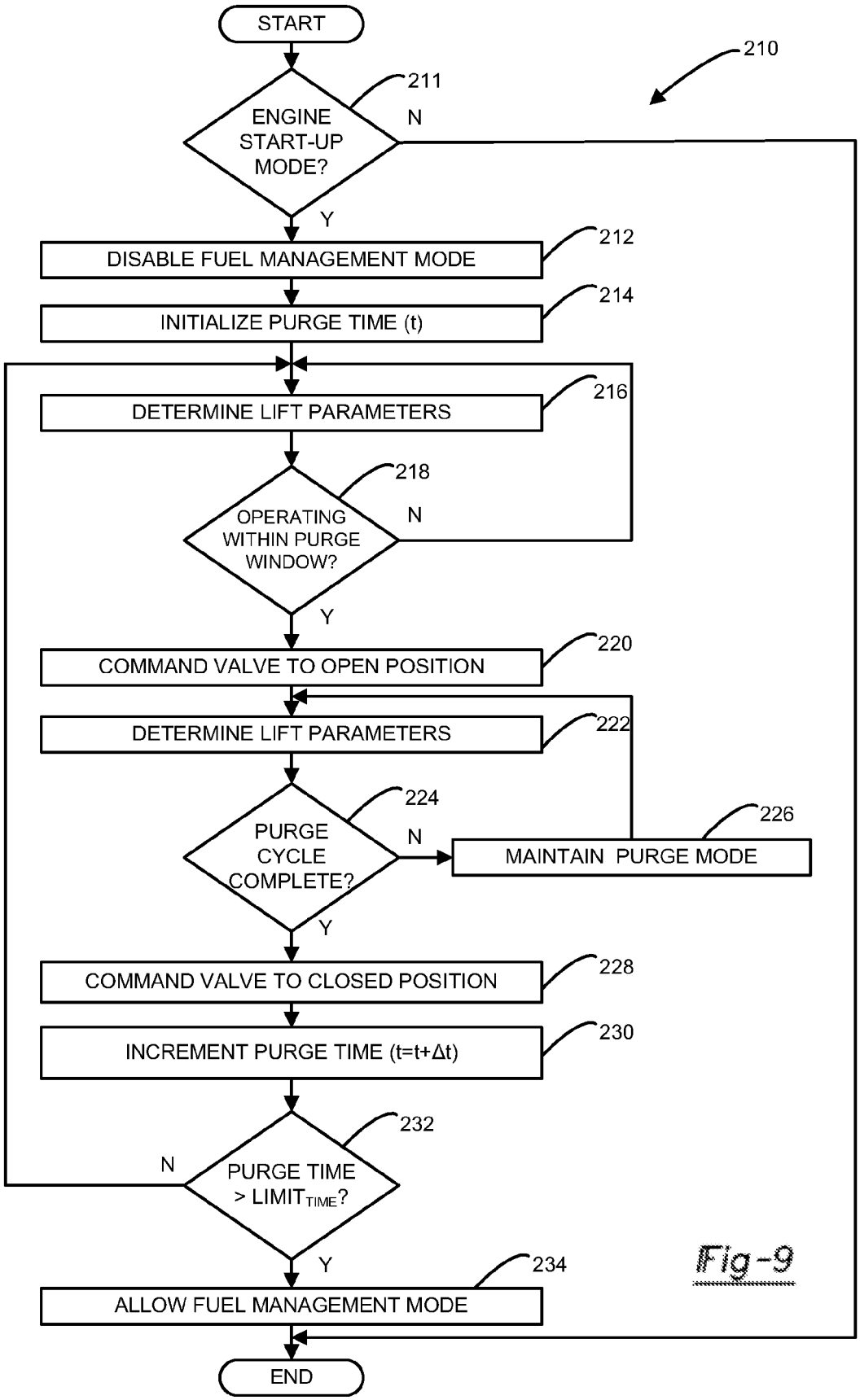
FIG. 9 is a second flow diagram illustrating control of the engine assembly of FIG. 1.

Alternatively, as illustrated in FIG. 9, the accumulated purge time may be monitored rather than the number of purge cycles to determine whether a sufficient amount of air has been purged from the system. Using the accumulated purge time may generally account for variation in engine speeds where the duration of a purge cycle is reduced.

Control logic 210, illustrated in FIG. 9, may be used during a start-up condition of the engine assembly 10. For simplicity, the following description of control logic 210 is directed to the cylinder 20*a*, with the understanding that the description applies equally to the cylinders 20*d*, 20*f*, 20*g*. Control logic 210 may begin at block 211 where an engine start-up condition is evaluated. If the engine is not in a start-up mode, control logic 210 may terminate. The start-up mode may generally include conditions such as an initial engine start, as well as conditions where the engine has not operated for a predetermined time and/or conditions where the engine temperature has not reached a predetermined limit.

If the engine is in a start-up mode, control logic 210 may proceed to block 212 where the control module 38 disables a fuel management mode of the engine assembly 10, preventing the engine assembly 10 from transitioning to the deactivated mode. Control logic 210 may then proceed to block 214 where a purge time (t) stored in the control module 38 is initialized to zero (t=0). Once the purge time has been initialized, control logic 210 may proceed to block 216 where lift parameters are determined.

The lift parameters may include one or more of engine speed, engine crank angle, and a purge window (W) duration. The purge window (W) duration may generally correspond to a time period and/or crank angle range where actuation of the valve 44*a* to the open position does not effect engine operation.

Control logic 210 may then determine if the engine assembly 10 is operating within the purge window (W) at block 218. If the engine assembly 10 is not operating within the purge window (W), control logic 210 may return to block 216. If the engine assembly 10 is operating within the purge window (W), control logic 210 may proceed to block 220 where the valve 44*a* is commanded to the open position, providing pressurized oil flow to the passages 50, 52 and forcing air therefrom as discussed above. Control logic 210 may then proceed to block 222 where lift parameters are again determined.

Once the lift parameters are determined, control logic 210 may determine if the purge cycle is compete at block 224. By way of non-limiting example, the determination may include evaluation of an elapsed operating time and engine speed and/or evaluation of a current crank angle relative to a crank angle range within the purge window (W). If the purge cycle is not complete, control logic 210 may proceed to block 226 where the valve 44*a* is maintained in the open position and then back to block 222 where lift parameters are again determined. If the purge cycle is complete, control logic 210 may proceed to block 228 where the valve 44*a* is commanded to the closed position, venting the passages 50, 52. Control logic 210 may then increment the purge time (t) by the elapsed time ($\Delta t$) of the purge cycle ($t=t+\Delta t$) at block 230. Control logic 210 may then evaluate the purge time (t) relative to a predetermined limit ($LIMIT_{TIME}$).

If the purge time (t) is less than the limit ($LIMIT_{TIME}$), control logic 210 may return to block 216, where lift parameters are determined for a subsequent purge cycle. If the purge time (t) is greater than or equal to the limit ($LIMIT_{TIME}$), control logic 210 may proceed to block 234, where the fuel management mode is allowed. Control logic 210 may then terminate.

For purposes of illustration, a non-limiting example of control logic 110 and 210 is discussed below with reference to FIG. 6. The crank angle range ($CA_1$ to $CA_2$) may generally define the purge window (W). The opening of the purge window (W) at $CA_1$ may generally correspond to a minimum lift condition ($L_{MIN}$) of the intake valve 30 providing the locking axial force discussed above. The closing of the purge window (W) may generally correspond to $CA_2$, just before the subsequent exhaust valve 32 lift condition. FIG. 6 illustrates the valve 44*a* being opened ($OCV_O$) just after $CA_1$ and closing just before the intake valve 30 falls below the minimum lift condition ($L_{MIN}$) during the closing ($OCV_C$) thereof. However, the valve 44*a* may be opened during the entire purge window (W) from $CA_1$ to $CA_2$. The valve 44*a* may be cycled in this manner until a desired number of purge cycles or purge time is attained.

Figure 10:
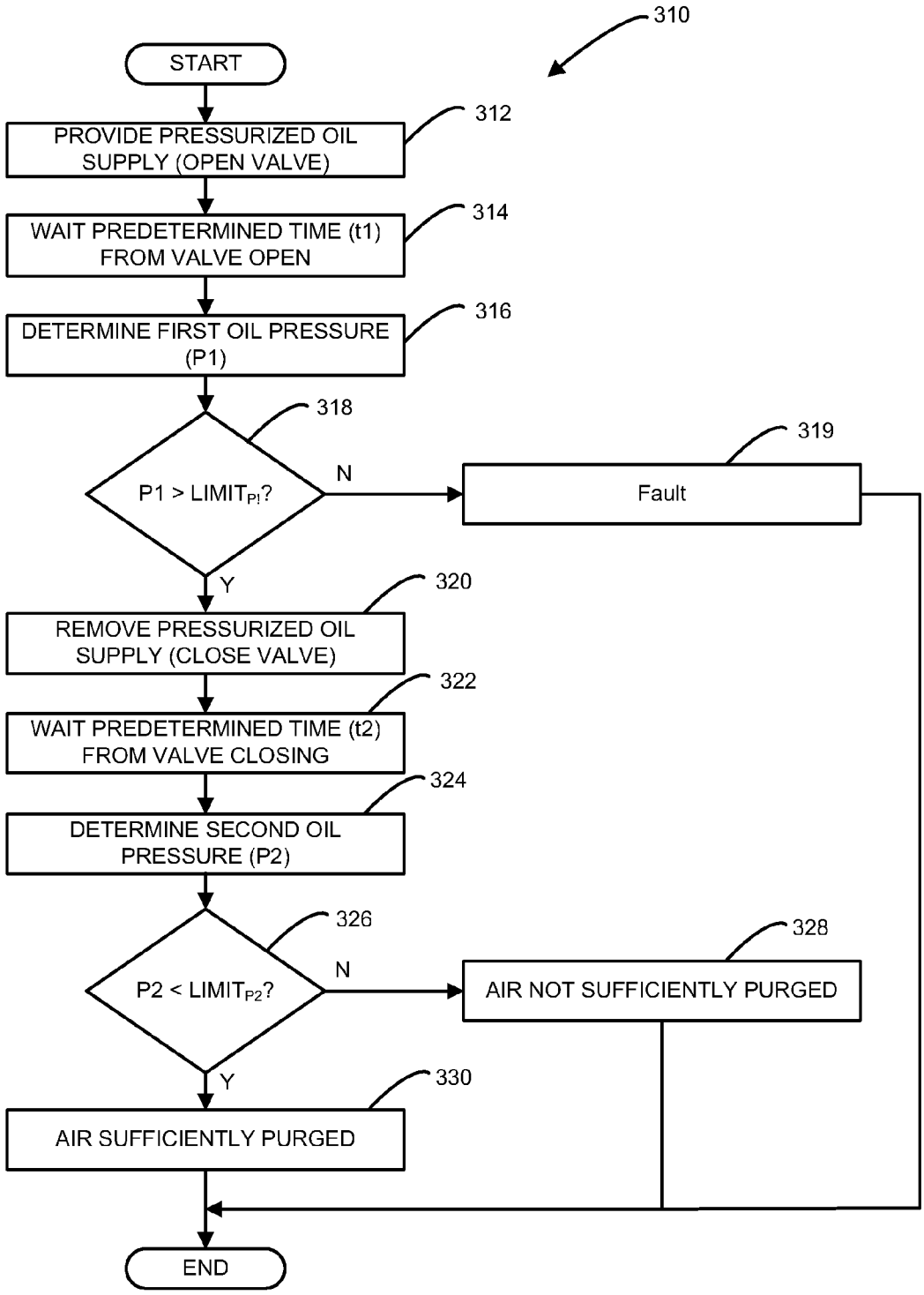
FIG. 10 is a third flow diagram illustrating control of the engine assembly of FIG. 1.

With reference to FIG. 10, control logic 310 is illustrated for determining a hydraulic stiffness (or air content) within a fluid passage. For purposes of illustration, control logic 310 is discussed with reference to the passages 50, 52. Control logic 310 may begin at block 312 where pressurized oil is provided to the passages 50, 52 at a predetermined time within the engine cycle so as not to change the normal valvetrain sequence. As discussed above, pressurized oil source 46 may be provided to the passages 50, 52 by actuating the valve 44*a* to the open position. Control logic 310 may then wait a first predetermined time (t1) as indicated at block 314. After the time (t1) has elapsed, a first oil pressure reading (P1) may be taken using the pressure sensor 100 as indicated at block 316. The first oil pressure reading (P1) may then be compared to a first predetermined limit ($LIMIT_{P1}$) at block 318. The first predetermined limit ($LIMIT_{P1}$) may generally correspond to a minimum pressure required to determine if the oil control system is operational. If the first pressure reading (P1) is less than the predetermined limit ($LIMIT_{P1}$), control logic 310 may proceed to a fault indicator block 319 that indicates that the oil pressure control system is not operable. Control logic 310 may then terminate. If the first pressure reading (P1) is greater than or equal to the first predetermined limit ($LIMIT_{P1}$), control logic 310 may proceed to block 320 where control logic 310 closes the valve 44*a* at a predetermined time and then proceeds to block 322. The valve 44*a* may be closed based on a valve lift parameter as discussed above, such as elapsed time.

The pressurized oil source 46 may be removed from communication with the passages 50, 52 by actuating the valve 44*a* to the closed position. After the valve 44*a* has been closed, control logic 310 may wait a second predetermined time (t2), as indicated at block 324. After the time (t2) has elapsed, a second oil pressure (P2) may be determined using the pressure sensor 100, as indicated at block 326. Control logic 310 may then proceed to block 328 where the second oil pressure (P2) is evaluated relative to a second predetermined limit ($LIMIT_{P2}$). The second predetermined limit ($LIMIT_{P2}$) may generally correspond to an atmospheric pressure with a range for system variation included.

If the second oil pressure (P2) is greater than the second predetermined limit ($LIMIT_{P2}$), control logic 310 may proceed to block 328 where a determination is made that the passages 50, 52 are not sufficiently purged of air. If the second oil pressure (P2) is below the second predetermined limit ($LIMIT_{P2}$), control logic 310 may proceed to block 330 where a determination is made that the passages 50, 52 are sufficiently purged of air. The passages 50, 52 may be sufficiently purged of air when a predetermined minimum response rate for transition of the deactivating lifter assemblies 24 to the deactivated mode is attainable. Control logic 310 may then terminate.

FIG. 7 generally illustrates various pressure curves displaying the air content conditions within the passages 50, 52 during engine operation. The first curve (C1) illustrates an initial condition where the passages 50, 52 are generally filled with air. The second curve (C2) illustrates an intermediate condition where the passages 50, 52 are partially purged of air. The third curve (C3) illustrates a final condition where the passages 50, 52 are sufficiently purged of air. The final condition may generally correspond to the passages 50, 52 being fully purged.

As described above with respect to control logic 310, the first pressure reading is below the first predetermined limit ($LIMIT_{P1}$), indicating that the oil control system is not functioning properly. By way of non-limiting example, the first predetermined limit ($LIMIT_{P1}$) may include an experimentally determined percentage of the pressurized oil source 46 immediately prior to the pressurized oil source 46 being provided to the oil passages 50, 52. The second pressure reading of the first and second curves is greater than the second predetermined limit, indicating that the passages 50, 52 are not sufficiently purged. The second pressure reading of the third curve (C3) is below the second predetermined limit (near atmospheric pressure), indicating that the passages 50, 52 are sufficiently purged.

Figure 11:
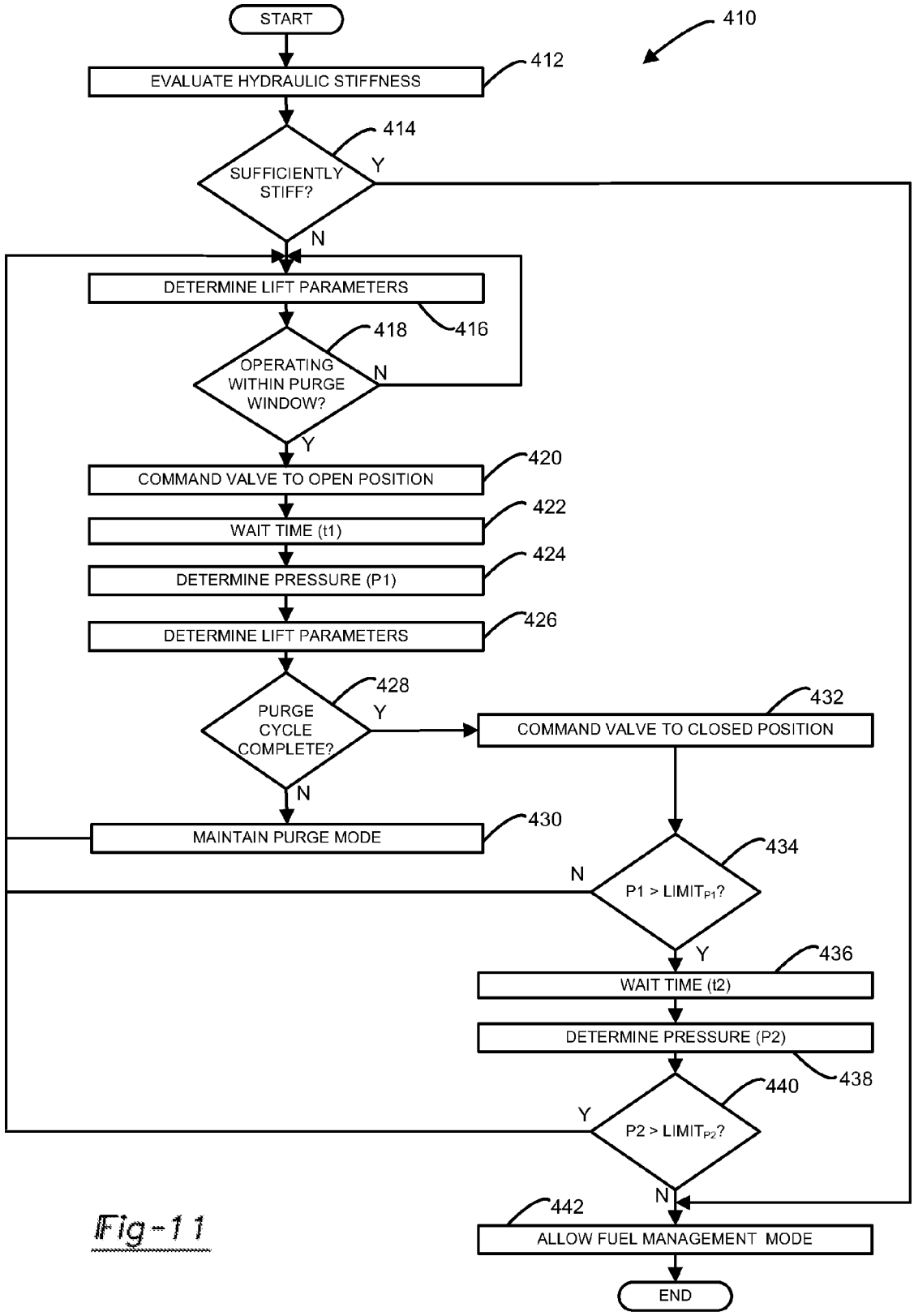
FIG. 11 is a fourth flow diagram illustrating control of the engine assembly of FIG. 1.

Control logic 110, 210 may be modified to determine when a sufficient amount of air has been purged from the passages 50, 52 using control logic 310 in place of using a predetermined number of purge cycles or an accumulated purge time. Control logic 410, illustrated in FIG. 11 illustrates such an example.

Control logic 410 may begin at block 412 where the hydraulic stiffness of the oil passages 50, 52 is initially determined as discussed above regarding control logic 310. The start of control logic 410 may correspond to the fuel management mode being disabled. Control logic 410 may then proceed to block 414. If the passages 50, 52 are sufficiently hydraulically stiff (according to the control logic 310 discussed above), control logic 410 may proceed to block 442 where the fuel management mode is again allowed and may then terminate. If the passages 50, 52 are not sufficiently hydraulically stiff (according to the control logic 310 discussed above), control logic 410 may proceed to block 416 where lift parameters are determined.

As discussed above, the lift parameters may include one or more of engine speed, engine crank angle, and a purge window (W) duration. The purge window (W) duration may generally correspond to a time period and/or crank angle range where actuation of the valve 44*a* to the open position does not effect engine operation.

Control logic 410 may then determine if the engine assembly 10 is operating within the purge window (W) at block 418. If the engine assembly 10 is not operating within the purge window (W), control logic 410 may return to block 416. If the engine assembly 10 is operating within the purge window (W), control logic 410 may proceed to block 420 where the valve 44*a* is commanded to the open position, providing pressurized oil flow to the passages 50, 52 and forcing air therefrom as discussed above. Control logic 410 may then wait a first predetermined time (t1) at block 422 and determine a first pressure reading (P1) using the pressure sensor 100 at block 424. Control logic 410 may then proceed to block 426 where lift parameters are again determined.

Once the lift parameters are determined, control logic 410 may determine if the purge cycle is complete at block 428. By way of non-limiting example, the determination may include evaluation of an elapsed operating time and engine speed and/or evaluation of a current crank angle relative to a crank angle range within the purge window (W). If the purge cycle is not complete, control logic 410 may proceed to block 430 where the valve 44*a* is maintained in the open position and then back to block 416 where lift parameters are again determined. If the purge cycle is complete, control logic 410 may proceed to block 432 where the valve 44*a* is commanded to the closed position, venting the passages 50, 52.

Control logic 410 may then evaluate the first pressure measurement (P1) at block 434. If the first pressure measurement (P1) is below a first predetermined limit ($LIMIT_{P1}$), control logic 410 may return to block 416. If the first pressure measurement (P1) is above the first predetermined limit ($LIMIT_{P1}$), control logic 410 may proceed to block 436. The first predetermined limit ($LIMIT_{P1}$) may correspond to the first predetermined limit ($LIMIT_{P1}$) discussed above with respect to control logic 310.

Control logic 410 may then wait a second predetermined time (t2) at block 436 and then determine a second pressure (P2) using pressure sensor 100 at block 438. Control logic 410 may then evaluate the second pressure (P2) relative to a second predetermined limit ($LIMIT_{P2}$) at block 440. If the second pressure (P2) is greater than the second predetermined limit ($LIMIT_{P2}$), control logic 410 may return to block 416. If the second pressure (P2) is below the second predetermined limit ($LIMIT_{P2}$), control logic 410 may proceed to block 442 where engine operation in the fuel management mode is allowed. Control logic 410 may then terminate.

Figure 12:
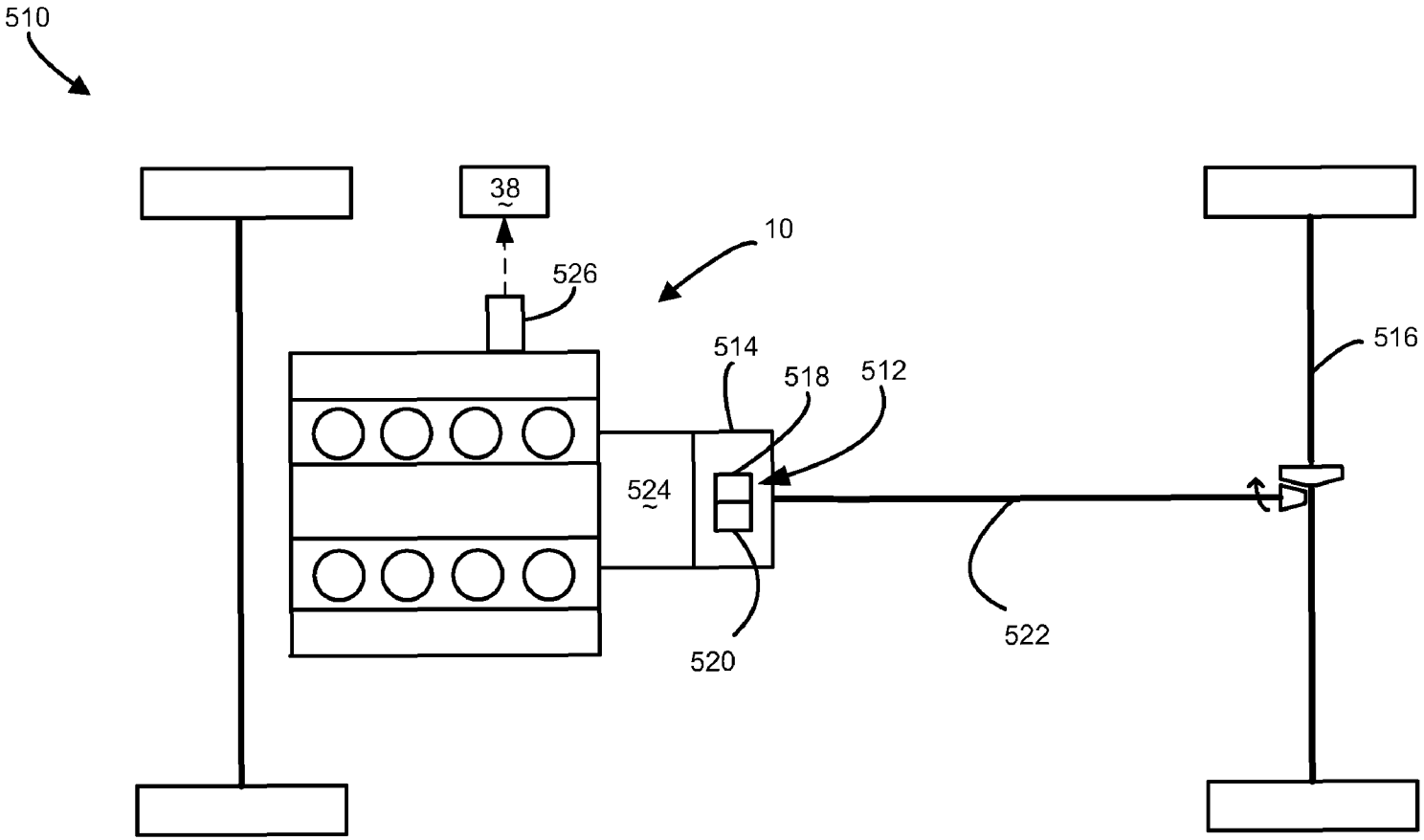
FIG. 12 is a schematic illustration of a hybrid vehicle according to the present disclosure.

Referring now to FIG. 12, a hybrid vehicle 510 is schematically illustrated. As seen in FIG. 12, the engine assembly 10 of FIG. 1 may be part of the hybrid vehicle 510. The hybrid vehicle 510 may additionally include a hybrid power assembly 512, a transmission 514 and a drive axle 516. The hybrid power assembly 512 may include an electric motor 518 and a rechargeable battery 520. The electric motor 518 and rechargeable battery 520 may form a drive mechanism for the hybrid power assembly 512. The motor 518 may be in electrical communication with the battery 520 to convert power from the battery 520 to mechanical power. The motor 518 may additionally be powered by the engine assembly 10 and operated as a generator to provide power to charge the battery 520. The hybrid power assembly 512 may be incorporated into and engaged with the transmission 514. The motor 518 may be coupled to an output shaft 522 to power rotation of the drive axle 516 via the transmission 514.

The engine assembly 10 may be coupled to the transmission 514 via a coupling device 524 and may drive the transmission 514. The coupling device 524 may include a friction clutch or a torque converter. The transmission 514 may use the power provided from the engine assembly 10 and/or the motor 518 to drive the output shaft 522 and power rotation of the drive axle 516. The engine assembly 10 may additionally include a temperature sensor 526 in communication with the control module 38. By way of non-limiting example, the temperature sensor 526 may include an engine coolant temperature sensor or an oil temperature sensor. In either arrangement, the control module 38 may determine oil temperature based on the signal provided by the temperature sensor 526.

In a first operating mode, the engine assembly 10 may drive the output shaft 522. In a second operating mode, the engine assembly 10 may be decoupled from the transmission 514 and the electric motor 518 may drive the output shaft 522. The engine assembly 10 may be shut off during the second operating mode. In a third operating mode, the engine assembly 10 may drive the electric motor 518 to charge the battery 520 and may drive the output shaft 522.

Figure 13:
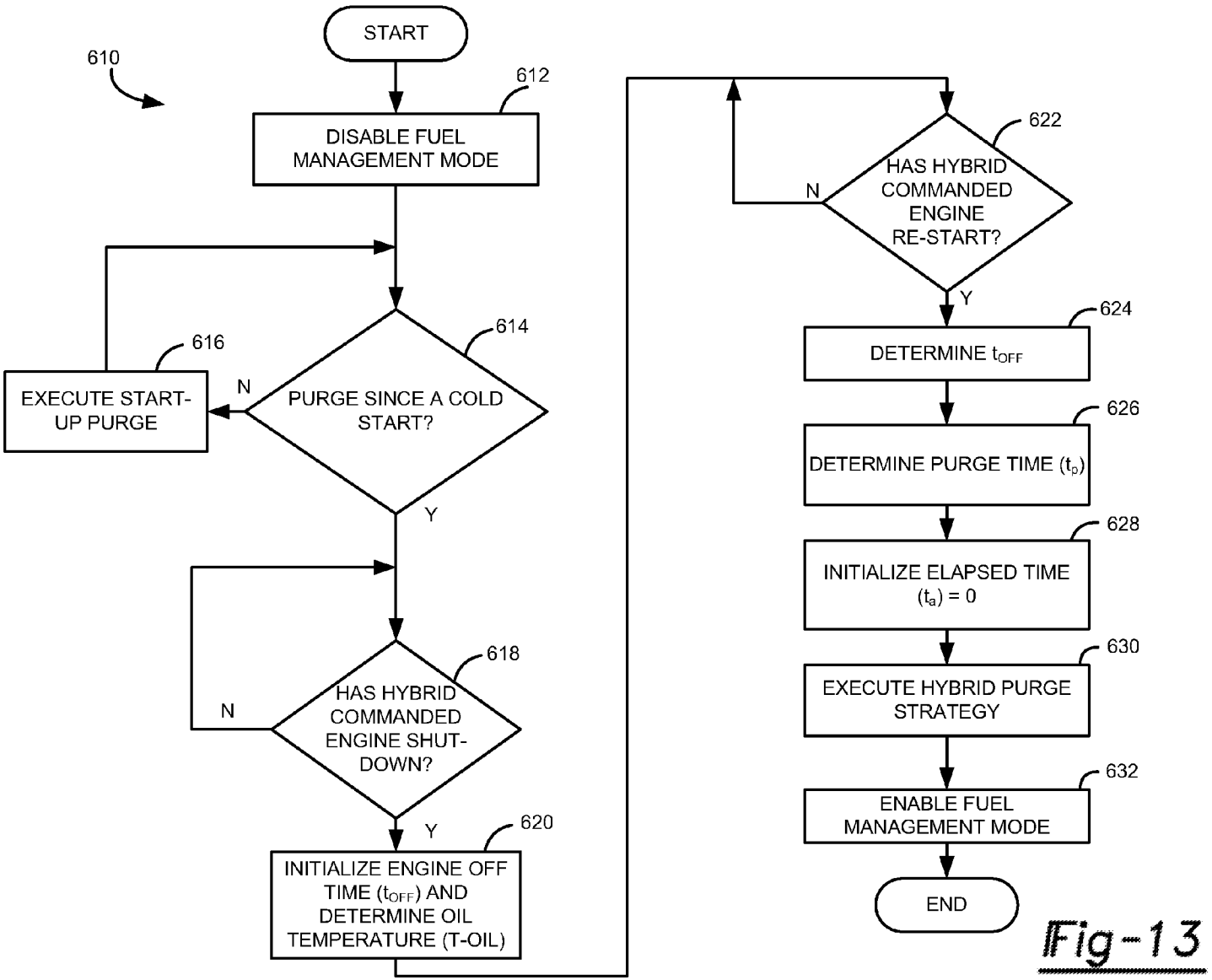
FIG. 13 is a fifth flow diagram illustrating control of the engine assembly of FIG. 1 relative to operation of the hybrid vehicle of FIG. 12.

An alternate control logic 610, illustrated in FIG. 13, may be employed for engine off conditions resulting from hybrid vehicle operation in the second operating mode. Control logic 610 may start at block 612 where the fuel management mode is disabled by the control module 38. Control logic 610 may then proceed to block 614 where the control module determines whether a purge cycle has been performed since engine start-up. If no purge cycle has been performed, the control logic 610 may proceed to block 616 where the control logic 210 illustrated in FIG. 9 is executed. Otherwise, control logic 610 may proceed to block 618 where hybrid operation is evaluated.

Block 618 evaluates whether the hybrid vehicle 510 has been operated in the second operating mode (engine off) since starting the hybrid vehicle 510. If the hybrid vehicle 510 has not been operated in the second operating mode, control logic returns to block 618. Otherwise, control logic 610 proceeds to block 620 where an engine off time ($t_{OFF}$) is initialized and the engine oil temperature ($T_{OIL}$) is determined. Control logic 610 then proceeds to block 622 where the hybrid operation is again evaluated.

Block 622 evaluates whether the engine assembly 10 has been re-started since operation of the hybrid vehicle 510 in the second operating mode (engine off). If the engine assembly 10 has not been restarted, control logic 610 returns to block 622 where the engine off timer ($t_{OFF}$) continues to run. If the engine assembly 10 has been restarted, control logic 610 proceeds to block 624 where the accumulated engine off time ($t_{OFF}$) is determined. Control logic 610 then proceeds to block 626 where a purge time ($t_P$) is determined. The purge time ($t_P$) may be determined using a look-up table based on the accumulated engine off time ($t_{OFF}$) and oil temperature ($T_{OIL}$). Control logic 610 may then proceed to block 628 where the elapsed time ($t_a$) for purge is initialized. Control logic 610 may then proceed to block 630 where a purge strategy is executed. After the purge strategy is executed, control logic 610 proceeds to block 632 where the fuel management mode is enabled. Control logic 610 may then terminate.

Figure 14:
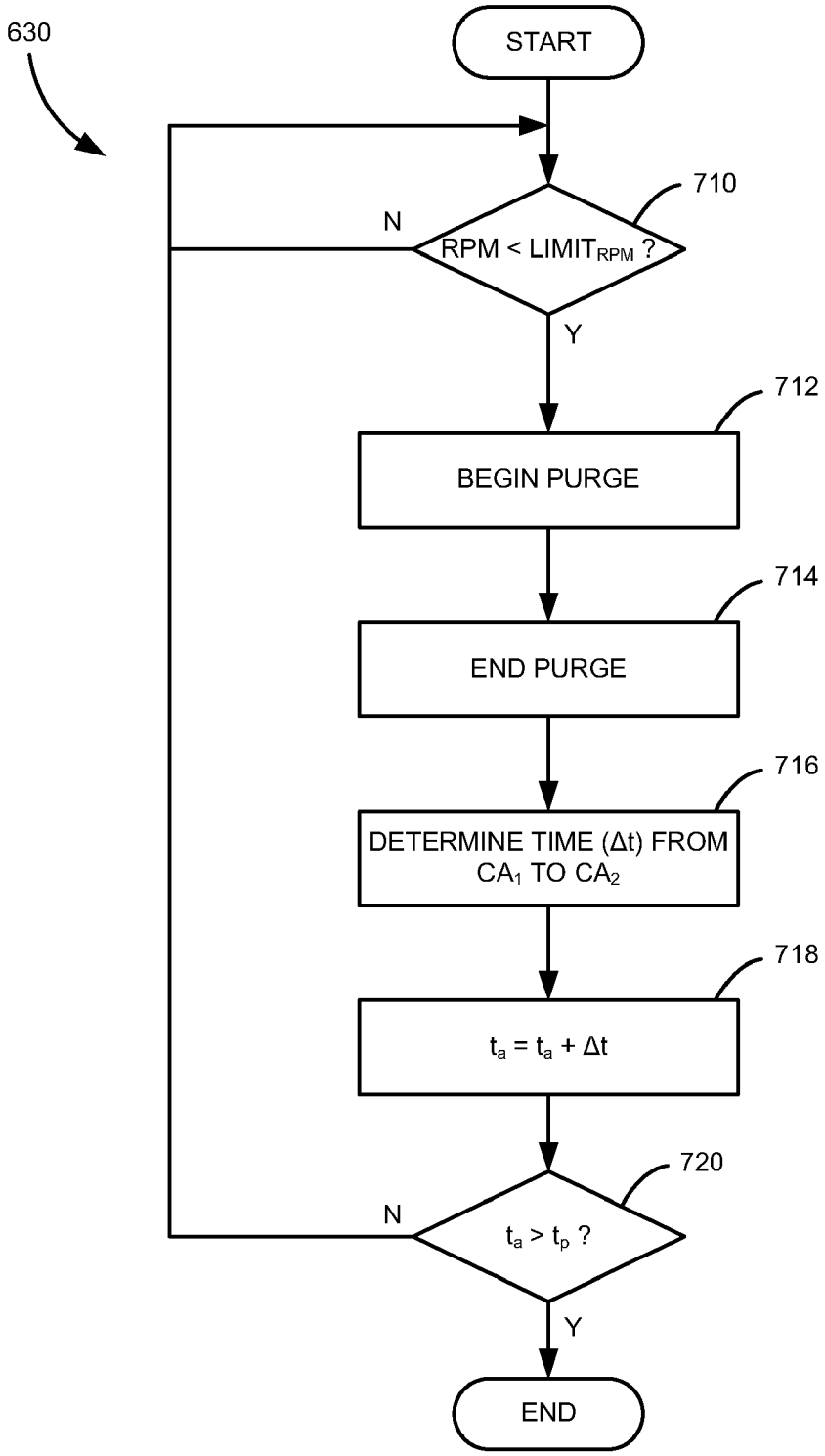
FIG. 14 is a sixth flow diagram further illustrating the control shown in FIG. 13.

An exemplary purge strategy 630 is illustrated in FIG. 14. The purge strategy 630 may begin at block 710 where engine speed (RPM) is evaluated relative to a predetermined limit ($LIMIT_{RPM}$). If the engine speed (RPM) is below the predetermined limit ($LIMIT_{RPM}$), the purge strategy 630 may return to block 710. Otherwise, the purge strategy 630 may proceed to block 712 where air may be purged from the passages 50, 52. As discussed above, air may be purged by commanding the valve 44*a* to the open position, providing pressurized oil flow to the passages 50, 52 forcing air therefrom. By way of non-limiting example, block 712 may begin at crank angle ($CA_1$) illustrated in FIG. 6. The purge strategy 630 may then proceed to block 714 where the valve 44*a* is commanded to the closed position. By way of non-limiting example, block 714 may close the valve 44*a* at crank angle ($CA_2$) illustrated in FIG. 6. The purge strategy 630 may then proceed to block 716.

At block 716, the time ($\Delta t_a$) from $CA_1$ to $CA_2$ may be determined at block 716. The purge strategy 630 may then proceed to block 718 where the elapsed time ($t_a$) is incremented ($t_a = t_a + \Delta t_a$). The purge strategy 630 may then proceed to block 720 where the elapsed time ($t_a$) is evaluated relative to the purge time ($t_p$). If the elapsed time ($t_a$) is greater than the purge time ($t_p$), the purge strategy 630 may terminate. Otherwise, the purge strategy 630 may return to block 710.

What is claimed is:

1. A method of purging air from an oil passage in an engine assembly, the engine assembly including an engine structure defining the oil passage, a first cam lobe rotationally supported by the engine structure and including a base region and a lift region, a first lifter assembly supported by the engine structure and in fluid communication with the oil passage, and a first valve supported by the engine structure and displaceable from a seated position to a lift position by the first lifter assembly, the first lifter assembly being switched from an activated mode to a deactivated mode by pressurized oil provided to the oil passage by a pressurized oil source, the activated mode including the first valve being in the seated position when the base region engages the first lifter assembly and being displaced from the seated position by the first lifter assembly when the lift region engages the first lifter assembly, the deactivated mode including the first valve remaining in the seated position when the lift region of the first cam lobe engages the first lifter assembly, the method comprising:

isolating the oil passage from the pressurized oil source while the first lifter assembly is engaged with the base region of the first cam lobe to operate the first lifter assembly in the activated mode;

providing the pressurized oil to the first lifter assembly via the oil passage after the isolating when the first lifter assembly is engaged with the lift region of the cam lobe, the first lifter assembly maintained in the activated mode after the providing; and purging air from the oil passage based on the pressurized oil provided to the oil passage.

2. The method of claim 1, wherein the first valve includes an intake valve, the engine structure defining an intake port in communication with a combustion chamber, the intake valve closing the intake port when in the seated position and opening the intake port when in the lift position.

3. The method of claim 2, wherein the providing is maintained until after the first lifter assembly is again engaged with the base region of the first cam lobe.

4. The method of claim 2, further comprising isolating the oil passage from the pressurized oil source after the providing while the first lifter assembly is engaged with the base region of the first cam lobe to maintain the first lifter assembly in the activated mode.

5. The method of claim 4, wherein the engine structure defines a combustion chamber and intake and exhaust ports in fluid communication with the combustion chamber, the engine assembly including an exhaust valve supported by the engine structure and displaceable from a seated position where the exhaust valve closes the exhaust port to an open position where the exhaust valve opens the exhaust port, the intake valve closing the intake port when in the seated position and opening the intake port when in a lift position, the isolating the oil passage from the pressurized oil source after the providing occurring before the exhaust valve is displaced to the lift position immediately subsequent to the providing.

6. The method of claim 1, wherein the providing occurs after the first valve is displaced a predetermined distance from the seated position by the lift region of the first cam lobe.

7. The method of claim 6, wherein the first lifter assembly includes a first housing member engaged with the first cam lobe, a second housing member engaged with the first valve, and a locking pin axially fixed to the second housing member and in fluid communication with the oil passage, the locking pin being displaceable from an engaged position to a disengaged position by the pressurized oil source, the locking pin fixing the first valve for axial displacement with the first housing when in the engaged position and providing relative axial displacement between the first housing and the first valve when in the disengaged position.

8. The method of claim 7, wherein the first housing member includes an opening, the locking pin extending radially into the opening when in the engaged position to couple the first valve for axial displacement with the first housing member, the first housing member applying a locking force to the locking pin when the locking pin is in the engaged position and the first valve is displaced at least the predetermined distance, the locking force preventing the pressurized fluid from displacing the locking pin to the disengaged position.

9. The method of claim 8, wherein the first lifter assembly includes a biasing member applying a biasing force urging the locking pin radially outward to the engaged position, the sum of the locking force and the biasing force being greater than a force applied to the locking pin by the pressurized oil in the oil passage.

10. The method of claim 9, wherein the pressurized oil applies a force on the locking pin greater than the biasing force.

11. The method of claim 1, wherein the engine structure defines a bore housing the first lifter assembly therein, the oil passage being in fluid communication with the bore and the purging forcing air from within the oil passage through a radial clearance defined between the first lifter assembly and the bore.

12. The method of claim 1, further comprising determining an air purge duration, the first lifter assembly being maintained in the activated mode when the air purge duration is below a predetermined air purge duration limit.

13. The method of claim 12, wherein the air purge duration includes an accumulated time of the purging air from the oil passage, the predetermined air purge duration limit including a minimum air purge time limit.

14. The method of claim 12, further comprising switching the first lifter assembly to the deactivated mode after the air purge duration exceeds the predetermined air purge duration limit, the switching including providing the pressurized oil to the first lifter assembly via the oil passage when the first lifter assembly is engaged with the base region of the cam lobe.

15. The method of claim 14, wherein operation of the first valve assembly in the deactivated mode is prevented until the air purge duration exceeds the predetermined air purge duration limit.

16. The method of claim 1, wherein the isolating and providing occur during 360 consecutive degrees of rotation of the first cam lobe.

17. The method of claim 1, further comprising removing the pressurized oil source from fluid communication with the oil passage after a predetermined duration of the providing.

18. The method of claim 1, wherein the engine assembly is part of a hybrid vehicle operable in a first mode where the engine assembly propels the vehicle and a second mode where the engine is off and an electric motor propels the vehicle, the purging occurring for a predetermined time after the vehicle transitions form the first mode to the second mode.

19. The method of claim 1, wherein the engine assembly includes an oil control valve (OCV) having an oil supply passage in fluid communication with the pressurized oil source and a vent passage in fluid communication with an engine oil sump, the oil supply passage being in fluid communication with the oil passage in the engine structure during the providing the pressurized oil to the first lifter assembly and the vent passage being in fluid communication with the oil passage in the engine structure during the isolating the oil passage from the pressurized oil source.

20. A method of purging air from an oil passage in an engine assembly, the engine assembly including an engine structure defining the oil passage, a first cam lobe rotationally supported by the engine structure and including a base region and a lift region, a first lifter assembly supported by the engine structure and in fluid communication with the oil passage, and a first valve supported by the engine structure and displaceable from a seated position to a lift position by the first lifter assembly, the first lifter assembly being switched from an activated mode to a deactivated mode by pressurized oil provided to the oil passage by a pressurized oil source, the activated mode including the first valve being in the seated position when the base region engages the first lifter assembly and being displaced from the seated position by the first lifter assembly when the lift region engages the first lifter assembly, the deactivated mode including the first valve remaining in the seated position when the lift region of the first cam lobe engages the first lifter assembly, the method comprising:

isolating the oil passage from the pressurized oil source while the first lifter assembly is engaged with the base region of the first cam lobe to operate the first lifter assembly in the activated mode;

providing the pressurized oil to the first lifter assembly via the oil passage after the isolating when the first lifter assembly is engaged with the lift region of the cam lobe, the first lifter assembly maintained in the activated mode after the providing;

purging air from the oil passage based on the pressurized oil provided to the oil passage; and providing the pressurized oil to the first lifter assembly via the oil passage after the purging when the first lifter assembly is engaged with the base region of the cam lobe to switch the first lifter assembly to the deactivated mode.

* * * * *